US005618196A

United States Patent [19]

Biswas

[11] Patent Number: 5,618,196

[45] Date of Patent: Apr. 8, 1997

[54] SOCKET CONNECTOR HAVING IMPROVED PROTECTION AGAINST ELECTROSTATIC DISCHARGES

[75] Inventor: Ranjit Biswas, Westford, Mass.

[73] Assignee: Lucent Technologies, Inc., Murray Hill, N.J.

[21] Appl. No.: 516,851

[22] Filed: Aug. 18, 1995

[51] Int. Cl.[6] ..... H01R 13/53

[52] U.S. Cl. ..... 439/18.1; 439/88; 439/931; 439/607

[58] Field of Search ..... 439/181, 193, 439/88, 607–610

[56] References Cited

U.S. PATENT DOCUMENTS

| | | | |
|---|---|---|---|
| 3,744,128 | 7/1973 | Fisher et al. | 439/931 |
| 4,514,029 | 4/1985 | Lax et al. | 439/931 |
| 4,747,785 | 5/1988 | Roberts et al. | 439/88 |
| 4,824,377 | 4/1989 | DeBurro | 439/186 |
| 4,906,201 | 3/1990 | Young et al. | 439/609 |
| 4,929,195 | 5/1990 | Seidoh | 439/88 |
| 5,199,903 | 4/1993 | Asick et al. | 439/610 |
| 5,338,227 | 8/1994 | Nakamura | 439/610 |
| 5,344,341 | 9/1994 | Yoshino | 439/931 |

*Primary Examiner*—P. Austin Bradley
*Assistant Examiner*—Jill Demello

[57] ABSTRACT

A socket connector having improved protection against electrostatic discharges. The body of the connector is encircled by a conductive shell and contains a plurality of female contacts for receiving respective pins of a pin connector. The surface of the body facing the pin connector is coated with conductive material which is coupled to the conductive shell through a conductive stripe on the body and a resilient conductive member contacting both the stripe and the shell. Charge reaching the conductive material from the pin connector is led harmlessly to ground from the shell.

15 Claims, 2 Drawing Sheets

SOCKET CONNECTOR HAVING IMPROVED PROTECTION AGAINST ELECTROSTATIC DISCHARGES

BACKGROUND OF THE INVENTION

1. Field of the Invention

This invention relates to a socket connector of the pin-and-socket type. When such a socket connector is unmated with a corresponding pin connector, it is susceptible to the undesired entry thereinto of electric currents resulting from the discharge of electrostatic charge that has accumulated on a human being or on a piece of apparatus which contacts or approaches the mating face of the socket connector. If such a discharge reaches any of the female connector contacts within the socket connector, the result can be a transient current from that connector contact or those connector contacts into circuitry conductively connected to the socket connector. If such circuitry includes certain types of solid-state devices, the devices may themselves be damaged by the transient current. Alternatively, data stored in solid-state memory chips may be lost or corrupted. Still further, if the socket connector is coupled to a telephone link or other communications circuit, it is possible for thousands of voice calls to be interrupted by spikes of undesirable noise caused by the transient current.

A most common source of electrostatic charge which might, unless prevented, discharge to one of the female connector contacts of the socket connector is the person holding or touching the socket connector. In the course of normal motions and activities such as scuffing shoes on a rug, a person can accumulate a charge at a voltage as high as 20,000 volts. This charge is developed by the process of frictional contact between unlike surfaces, sometimes called "triboelectric charging." Often, this triboelectric charge leaks away without the person even being aware that he or she has been charged and discharged. Sometimes, however, especially when the air is very dry, a person becomes distinctly aware that he is a charge carrier when a spark is drawn as he approaches a door knob or other metallic object to take hold of it.

Such a spark is a matter of extreme concern in the protection and handling of dataprocessing and communications equipment, especially if valuable data are stored therein or if valuable messages are being transmitted therethrough. Even if there is no perceptible spark, the amount of charge transmitted to and discharged through a socket connector by a person can be sufficient to cause damage. One particular time when such damage is especially likely is when a pin connector is being maneuvered toward the socket connector for the purpose of mating the two portions of the connector. Before the mating step is complete, a discharge may take place between one or more pins of the pin connector and one or more of the female connector contacts of the socket connector. Unless prevented, this discharge may take place even though the female connector contacts are recessed behind the mating face of the socket connector, and even though the body of that connector is made of an insulative material. If no structural modifications of the socket connector are made, a damaging discharge may take place despite careful precautions on the part of the person mating the two portions of the connector. That is to say, even though the person takes pains to "discharge himself" before he picks up the two members of the connector to mate them, the two members may nevertheless be at substantially different electric potentials and may draw a harmful spark before they are fully mated.

2. Description of the Prior Art

In the past, special precautions have been taken in the design of modem interface connectors in order to protect electronic equipment conductively coupled to one or more members of the respective interface connectors. In some cases, electrical filter components have been built into each contact of each member of each interface connector. However, this approach has been so expensive as to be impractical. Moreover, the space available within multi-pin connectors is not sufficient to accommodate filter components capable of significantly improving the safety performance of such interface connectors.

Another approach which is more practical and which has significantly improved safety performance is that which is described in U.S. Pat. No. 4,824,377, issued to Agostino L. DeBurro on Apr. 25, 1989. That patent discloses a socket connector in which the mating face incorporates a conductive sheet or a wire which surrounds the passageways in the face of the connector through which the pins of the pin connector must pass in order to mate with the respective female connector contacts having proximate ends set back slightly from the face of the socket connector. The conductive sheet or wire is connected to the metallic shell of the socket connector, which is in turn grounded so as to drain away any charge that may jump from the pins of the pin connector to the conductive sheet or wire. The connector in accordance with the DeBurro patent represented a substantial step forward, but the precise placement of the conductive sheet or wire on the face of the connector was an expensive operation.

SUMMARY OF THE INVENTION

Briefly, this invention improves upon the socket connector disclosed in the DeBurro patent by providing a socket connector in which the mating face is partially covered with a coating or film composed of a polymer in which are dispersed conductive metallic particles that intercept and conduct away to ground any charge which reaches the conductive particles by sparking or otherwise. The conductive coating or film may be applied to the face of the socket connector in such a way that it does not penetrate the passageways in which the female connector contacts are recessed. This may be accomplished by a process of rolling, or printing through a screen. The conductive coating or film on the face of the connector is electrically coupled to a similarly conductive stripe that is applied to the sidewall of the body of the connector and which may itself be nonconductive. The conductive stripe is in mm electrically coupled to the inner surface of the metallic shell of the connector through resilient means such as a metal spring which contacts both the conductive stripe and the inner surface of the metallic shell of the connector.

BRIEF DESCRIPTION OF THE DRAWINGS

The invention summarized above will be described in detail in the following specification. The specification will be best understood if read while referring to the accompanying drawings, in which.

DETAILED DESCRIPTION OF THE PREFERRED MODE OF CARRYING OUT THIS INVENTION

Figure 3:
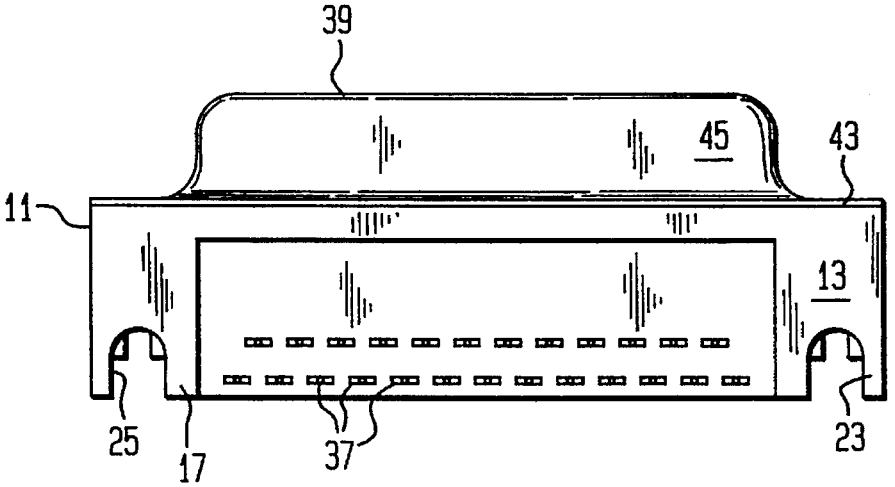
FIG. 3 is a bottom view of the socket connector showing typical positioning of output pins leading from the socket connector to other equipment.

The principles of this invention will hereinafter be illustrated in terms of the configuration of the familiar "DB-type" connector which is commonly used in the telephone electronics and computer industries. In this type of connector, the female connector contacts are arrayed parallel to one another within the body of the connector so as to receive the respective pins of a corresponding pin connector to be mated therewith. The leads from the respective female connector contacts are re-directed at an angle of 90° with the initial direction of the female connector contacts so as to produce a new array of pins suitable to plug into a circuit board such as the "OC-3 user panel" for transmission equipment. The arrangement of the last-mentioned array of pins is illustrated in FIG. 3 of the drawings. The "DB-type" connector is a 25-pin socket connector in which the passageways for entry of the pins are arrayed in one row of 13 and a parallel row of 12 passageways. Although this configuration of connector has been chosen for purposes of illustration, the principles of this invention are not limited to the configuration just described.

Figure 4:
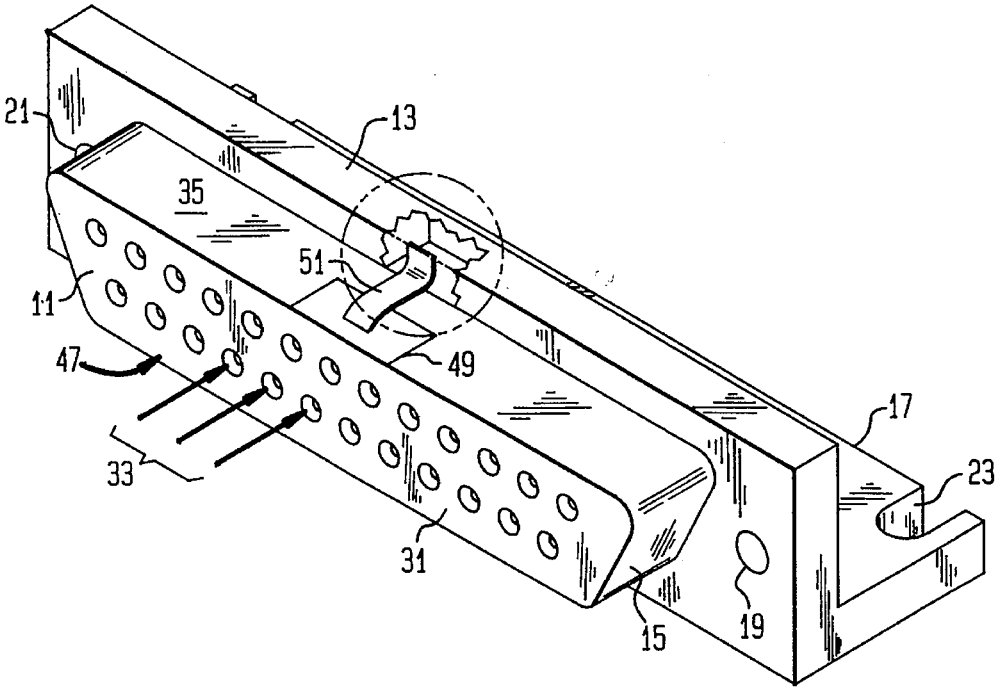
FIG. 4 is a perspective view of the non-conductive body of the socket connector, illustrating a conductive stripe on the sidewall of the body of the connector and, through a partial cutaway, resilient conductive means for connecting the stripe to the inner surface of the metallic shell of the connector.
Figure 5:
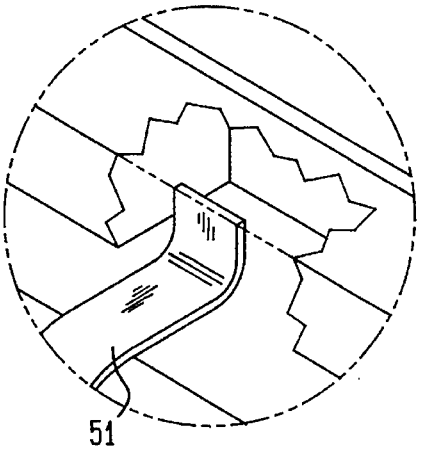
FIG. 5 is a perspective view, on a larger scale, of a portion of the resilient conductive means revealed in the cutaway portion of FIG. 4.

Turning to FIG. 4 of the drawings, we find a body 11, which may be formed from plastic or other electrically-insulative material. Body 11 comprises a body flange 13 having thereon a front protrusion 15 and a rear protrusion 17, which may or may not be formed integrally with body flange 13. Near the respective ends of body flange 13 are formed a first aperture 19 and a second aperture 21 for affixation of a conductive metal shell to body flange 13. Near the respective ends of rear protrusion 17 are formed a first mounting slot 23 and a second mounting slot 25 to accommodate bifurcated mounting tabs adapted to lock the connector into suitable bushings or other receptacles formed in the circuit board to which the connector may be affixed. If desired, the mounting tabs may be formed of resilient material.

From protrusion 15 terminates in a face 31 which may be generally flat in overall configuration. However, penetrating face 31 are a plurality of passageways 33, the number of which corresponds to the number of pins by which connection is to be made with a corresponding pin connector to be mated with this socket connector. Extending from face 31 to body flange 13 of body 11 is a body sidewall 35 which may be formed approximately perpendicular to face 31 and to body flange 13.

Within body 11 may be formed a plurality of housing channels for receiving female connector contacts, one contact per housing channel. Presumably, the number of housing channels, and of female connector contacts therein, should be equal to the number of passageways 33 formed in face 31 of body 11. The female connector contacts may be bifurcated in configuration and may be formed from resilient and highly-conductive metal. Each female connector contact should be conductively coupled to a pin 37, as depicted in FIG. 3 of the drawings. In the "DB-type" connector, as aforementioned, the coupling is through a right-angle bend in the conductive material.

Figure 2:
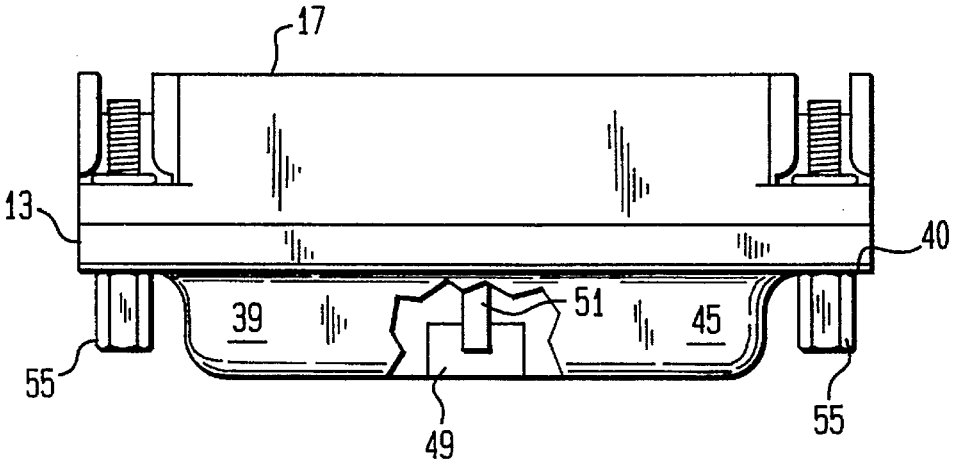
FIG. 2 is a top view of the socket connector in which a portion of the metallic shell of the connector has been broken away to show a conductive stripe on the non-conductive body of the connector.

In the "DB-type" connector, body 11 is surrounded by a conductive shell 39 which has a crimped edge 41 that tightly grips the periphery of face 31 of body 11. Moreover, as illustrated in FIG. 2 and FIG. 3, conductive shell 39 also has a shell flange 43 and a shell sidewall 45, which surrounds body sidewall 35 of body 11.

On face 31 of body 11 is a conductive coating 47 or film of suitable material. This material may preferably be a polymer in which a large number of finely-divided metallic particles are evenly dispersed to impart conductivity to the polymeric material. The conductive coating 47 or film may be screen printed onto face 31 or applied thereto by a roller or through a stencil. If the conductive polymeric material is applied through a stencil, the stencil should be positioned precisely to prevent conductive polymeric material from entering passageways 33 formed in face 31 of body 11.

If the conductive polymeric material is applied to face 31 by a process of printing through a screen, it may be necessary to plug temporarily passageways 33 so that the conductive material will not enter them. If the conductive polymeric material is applied by means of a roller, it has been found that one pass of the roller over face 31 is generally sufficient, and it may not be necessary temporarily to plug passageways 33.

The metal which is preferable for dispersion in the polymeric material to form the conductive coating 47 on face 31 is silver, which is, of course, the most electrically conductive. However, particles of copper or nickel may be employed in lieu of silver in order to save expense. If copper is to be used as the metallic material dispersed in the polymer, I have found that MINICO M-6300 Copper Paste is a satisfactory dispersion to be used in the formation and deposition of conductive coating 47. This is a dispersion of freely divided copper in polymer and is distributed by MINICO of Congers, N.Y.

An important feature of this invention is the coupling to conductive coating 47 of a conductive stripe 49, which should be applied to body sidewall 35 of body 11, and in intimate electrical contact with conductive coating 47. Conductive stripe 49 may be formed by brushing or rolling onto body sidewall 35 a conductive polymeric paste similar to that which is used in the formation of conductive coating 47. Alternatively, conductive stripe 49 may comprise a metallic foil which is retained in place on body sidewall 35 by an adhesive. Conductive stripe 49 should extend from face 31 a substantial portion of the distance toward body flange 13. While it is not necessary for conductive stripe 49 to extend all the way around body sidewall 35, the width of conductive stripe 49 should be sufficient to ensure that a good electrical contact can be made therewith.

Figure 6:
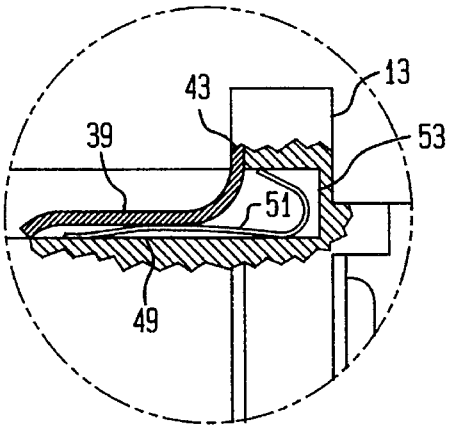
FIG. 6 is a partial sectional view through a portion of the body of the socket connector, as seen from one end thereof, and showing the resilient conductive means in contact with the metallic shell of the connector and also with the conductive stripe on the sidewall of the body of the connector.

A further important feature of this invention is the interposition, between conductive stripe 49 and the inner surface of conductive shell 39, of a resilient conductor such as a metallic spring 51. If desired metallic spring 51 may take the form of a "leaf spring" having one long leg which is arched to form a relatively flat "summit" intermediate the ends of the spring. Such a "leaf spring" is shown clearly in FIG. 4 and FIG. 6 of the drawings. It is desirable for one end of metallic spring 51 to be in firm electrical contact with conductive stripe 49, whereas the arched portion of metallic spring 51 should be in firm electrical contact with the inner surface of conductive shell 39 as shown in FIG. 6. It would also be possible to have the end of metallic spring 51 in contact with the inner surface of conductive shell 39, while the arched portion of metallic spring 51 would then be in firm electrical contact with conductive stripe 49.

If the first-described configuration of metallic spring 51 is chosen, it is desirable to retain metallic spring 51 in place by seating the other end of metallic spring 51 in a cavity 53 formed in body flange 13 of body 11. If this configuration is chosen, the last-mentioned end of metallic spring 51 may be "curled,"0 as shown in FIG. 6 of the drawings, so that metallic spring 51 is in effect "cantilevered," or at least secured, by a firm seating in cavity 53 of body flange 13. Phosphor bronze is a desirable material for metallic spring 51. However, other resilient conductive materials might be selected for this purpose. Of course, conductive stripe 49 should be applied to body sidewall 35 in a location on the sidewall such that conductive stripe 49 is aligned with cavity 53 in body flange 13 and so that metallic spring 51, retained within cavity 53, will bear firmly on conductive stripe 49.

PERFORMANCE OF SOCKET CONNECTOR IN ACCORDANCE WITH THIS INVENTION

It has been noted in foregoing paragraphs that the ends of the female connector contacts within the housing channels of body 11, and most nearly proximate to face 31 of body 11, are nevertheless appreciably set back from face 31 within the respective housing channels of body 11. When conductive coating 47 is deposited or otherwise formed on face 31 of body 11, the female connector contacts do not touch conductive coating 47. The female connector contacts are typically recessed from conductive coating 47 by a distance between about 0.040 inch and 0.070 inch.

When a "charged person" or a piece of apparatus bearing an electrostatic charge approaches conductive coating 47, it is important that any discharge, whether or not in the form of a spark, take place to conductive coating 47 rather than to the female connector contacts which are disposed behind passageways 33, in the respective housing channels of body 11. The charge is then harmlessly drained away from conductive coating 47 through conductive stripe 49 and metallic spring 51 to conductive shell 39. Shell flange 43 is in turn electrically coupled through fasteners, such as rivets or bolts 55, to the aforementioned bifurcated tabs by which the connector is retained in place on the circuit board or other sub-assembly with which the connector is intended to cooperate. The circuit board or other sub-assembly, in ram, provides a firm "ground" to absorb the charge which would have caused damage had it entered the female connector contacts. For instance, the OC-3 user panel has printed thereon a ground bus in firm contact with the bushings to which the tabs of the connector are to be affixed.

As a charge-bearing body, such as a pin of the corresponding pin connector, approaches the surface of conductive coating 47, the occurrence of a spark discharge from the charge-bearing body to or from conductive coating 47 will be determined by the electric gradient in the air between them. That gradient will be determined by the amount of electrostatic charge and by the curvatures of the surface bearing the charge and of conductive coating 47. A high degree of curvature, such as is found in a sharp edge or point, results in a concentration of electrostatic charge and, consequently, a high electric gradient in the air nearby. From the standpoint of ensuring that any such discharge does in fact reach conductive coating 47, it is desirable for conductive coating 47 to have relatively sharp edges around passageways 33 in face 31 of body 11.

In preventing a possibly catastrophic discharge from reaching one or more of the female connector contacts within the housing channels, the "worst-case scenario" occurs if a sharply-pointed, charge-bearing object approaches one or more of the aforementioned passageways along a center line passing through the center of the passageway. In any other scenario, the discharge will be more likely to take place to conductive coating 47 and less likely to penetrate any of the passageways 33, possibly reaching one or more of the female connector contacts. In order to avoid any risk of a discharge reaching a female connector contact, the distance from a point on the center line of each of the aforementioned passageways to the closest portion of conductive coating 47 should be substantially less than the distance from that point on a passageway center line to the nearest point on the nearest female connector contact. Stated in another way, the radius of each passageway 33 should be significantly less than the distance by which each female connector contact is recessed or set back from face 31 of body 11. Still further, it must be recognized that the proximate end of one or more female connector contacts might be more sharply curved than the inner edge of conductive coating 47 where it borders on passageways 33. Accordingly, the induced electric gradients around the proximate ends of one or more female connector contacts might be greater than the induced gradient around the conductive coating 47 where it borders on passageways 33 unless the setback of the female connector contacts from face 31 of body 11 is made enough greater than the radius of passageways 33 to avoid any such risk.

Figure 1:
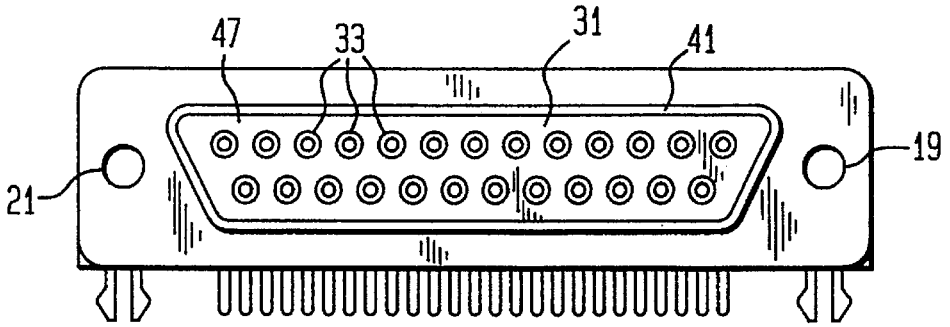
FIG. 1 is an elevation view of the socket connector, assuming that the socket connector is to be approached horizontally by the corresponding pin connector.

FIG. 1 of the drawings is an elevation view of a socket connector in which passageways 33 are circular in cross section. It would also be possible for the cross section of passageways 33 to be square or hexagonal, or even irregularly shaped. The cross section of the passageways could be a polygon having anywhere from 3 up to an infinite number of sides. In such a case, one-half the major diagonal of the polygon defining the cross section of passageways 33 should be substantially less than the setback of the proximate ends of the female connector contacts from face 31 of body 11.

The performance and safety of the socket connector in accordance with this invention are at least equal to the performance and safety of the aforementioned patented connector of DeBurro. They are superior to the performance and safety of all other prior art known to the present inventor. Moreover, the cost of the socket connector disclosed and claimed herein is substantially less than the cost of any other socket connector.

The configurations of the socket connector regarded as being most favorable for carrying out the principles of this invention have been fully set forth and described in this specification. Nevertheless, it is possible that certain variations in the connector as shown and described may be made by others without departing from the principles of the invention or the significant features thereof. Accordingly, the scope of the invention is defined by the appended claims, together with the equivalents thereof.

What I claim is:

1. A socket connector comprising in combination:

(a) a body of electrically insulative material and having a face and a sidewall disposed at an angle with said face, said body having formed therein a plurality of housing channels to accommodate female connector contacts, said plurality of housing channels being arranged substantially parallel to one another and substantially perpendicular to said face of said body so as to form in said face a plurality of passageways, one at an end of each housing channel, for receiving pins of a corresponding pin connector;

(b) a plurality of female connector contacts, each positioned in one of said housing channels for making conductive connection with a pin of said corresponding pin connector, said pin to be inserted into said socket connector through the passageway of one of said housing channels, each such female connector contact having a proximate end which is set back into said body from said face thereof;

(c) a conductive shell embracing said body and having an edge which surrounds and grips said face of said body;

(d) a conductive coating on at least a portion of said face not occupied by said passageways;

(e) a conductive stripe covering at least a portion of said sidewall of said body and in conductive contact with said conductive coating on said face thereof; and (f) resilient conductive means interposed between said conductive shell and said conductive stripe and in electrical contact with both of them.

2. A socket connector in accordance with claim 1 in which said body is formed of plastic material.

3. A socket connector in accordance with claim 1 in which said conductive shell is formed of metal.

4. A socket connector in accordance with claim 1 in which said passageways are round.

5. A socket connector in accordance with claim 4 in which the setback of the proximate end of each female connector contact is greater than the radius of the passageway of the channel in which the female connector is positioned.

6. A socket connector in accordance with claim 1 in which said passageways are polygonal in cross section.

7. A socket connector in accordance with claim 6 in which the setback of the proximate end of each female connector contact is greater than one-half the major diagonal of said polygonal cross section.

8. A socket connector in accordance with claim 1 in which said conductive coating comprises a dispersion of finely-divided metal particles in a polymer.

9. A socket connector in accordance with claim 8 in which said finely-divided metal particles are silver.

10. A socket connector in accordance with claim 8 in which said finely-divided metal particles are copper.

11. A socket connector in accordance with claim 8 in which said finely-divided metal particles are nickel.

12. A socket connector in accordance with claim 1 in which said resilient conductive means comprises a spring.

13. A socket connector in accordance with claim 12 in which said spring is formed of phosphor bronze.

14. A socket connector in accordance with claim 1, further including pin means respectively connected to said plurality of female connector contacts, and arrayed in a formation adapted for mating with respective receptacles on a circuit board.

15. A socket connector in accordance with claim 14 in which said pin means are oriented substantially at right angles with said female connector contacts.

* * * * *